US005177991A

United States Patent [19]

Sansoucy

[11] Patent Number: 5,177,991

[45] Date of Patent: Jan. 12, 1993

[54] METHOD OF AND APPARATUS FOR COINING TAPERS AT OPPOSITE ENDS OF A SLEEVE MEMBER

[75] Inventor: Reynald Sansoucy, Worcester, Mass.

[73] Assignee: Presnet Corporation, Worcester, Mass.

[21] Appl. No.: 750,926

[22] Filed: Jul. 28, 1991

[51] Int. Cl.[5] ..... B21J 13/00

[52] U.S. Cl. ..... 72/355.6; 72/360

[58] Field of Search ..... 72/355.2, 355.6, 360

[56] References Cited

U.S. PATENT DOCUMENTS

| | | | |
|---|---|---|---|
| 659,522 | 10/1900 | Furbish | 72/355.6 |
| 2,480,011 | 8/1949 | Freter | 72/360 |
| 2,827,007 | 3/1958 | Wurzburger | 72/355.6 |
| 4,918,967 | 4/1990 | Ishinaga | 72/355.6 |

FOREIGN PATENT DOCUMENTS

| | | | |
|---|---|---|---|
| 0321880 | 6/1989 | European Pat. Off. | 72/355.6 |
| 0070955 | 6/1978 | Japan | 72/355.2 |
| 0018445 | 1/1991 | Japan | 72/355.6 |

*Primary Examiner*—David Jones
*Attorney, Agent, or Firm*—Darby & Darby

[57] ABSTRACT

A method of and apparatus for coining tapers at opposite end faces of a sleeve member in which upper and lower punches are displaced relative to upper and lower dies, respectively, before start of a coining operation, to engage the opposite end faces of the sleeve member. Thereafter, the upper die is advanced together with the upper punch to effect coining. The sleeve member is supported at both its opposite end faces during the entire coining operation.

9 Claims, 4 Drawing Sheets

METHOD OF AND APPARATUS FOR COINING TAPERS AT OPPOSITE ENDS OF A SLEEVE MEMBER

BACKGROUND OF THE INVENTION

1. Field of the Invention

The invention relates generally to a method of and apparatus for coining tapers at opposite ends of sleeve members. In particular, the invention relates to a method of and an apparatus for coining tapers at opposite ends of guide members for guiding the valve stem of valves for internal combustion engines, especially for guides made of a powdered metal.

2. Description of the Prior Art

An apparatus for and a method of coining tapers or leads at opposite ends of guides for valve stems of valves are known.

A conventional apparatus used with a crank press includes upper and lower cooperating dies to coin tapers at opposite ends of a guide sleeve. The lower die has a tapered bore defining a coining surface for producing the lower taper. The upper die has a tapered inner surface at an end thereof. A rod support member extends through the bore of the lower die for supporting a guide sleeve blank thereon. The guide sleeve blanks are loaded on the support rod and extend into the bore of the lower die to an upper edge of the tapered coining surface. During the coining operation, the upper die presses the blank downward so that tapers at opposite ends of the blank are coined. Upon finishing the coining portion of the cycle, a lower punch ejects the completed guide sleeve. A drawback of this method is that the end faces of the guide sleeves, which are made of a powdered metal, are susceptible to cracking. In practice, the rejection rate of such guide sleeves obtained by this method is very high.

SUMMARY OF THE INVENTION

A principal object of the subject invention is to overcome the above-mentioned drawback and to provide an improved method and apparatus which eliminates cracking at the end faces of the guide sleeves. This and other objects and advantages of the invention are obtained in apparatus in which a lower punch and an upper punch are moved prior to the beginning of the coining operation into engagement with opposite end faces of the blank to completely support the blank during coining operation. To this end, the lower and upper punch are fixedly connected respectively to lower and upper pistons displaceable in lower and upper cylinders, respectively. Prior to the beginning of the coining operation, air pressure is introduced into the respective lower and upper cavities in the lower and upper cylinders and causes movement of the respective lower and upper pistons to bring the lower and upper punches into engagement with the opposite end faces of the guide sleeve blank. Thereafter, the coining operation begins by moving the upper die together with the upper punch in the conventional manner. During the compression stroke, the guide sleeve blank is firmly supported at its opposite end faces by lower and upper punches which are displaced against the air pressure cushion during the actual coining of the ends. The foregoing improvement of the method of and apparatus for coining opposite ends of guide sleeves almost totally eliminate cracking at the end faces of the guide sleeves.

BRIEF DESCRIPTION OF THE DRAWINGS

The above-mentioned and other features and advantages of the subject invention and the manner of obtaining the same will become more apparent and the invention itself will be best understood from the following detailed description of the preferred embodiment when read with reference to the accompanying drawings, wherein.

DETAILED DESCRIPTION OF THE PREFERRED EMBODIMENT

Figure 1:
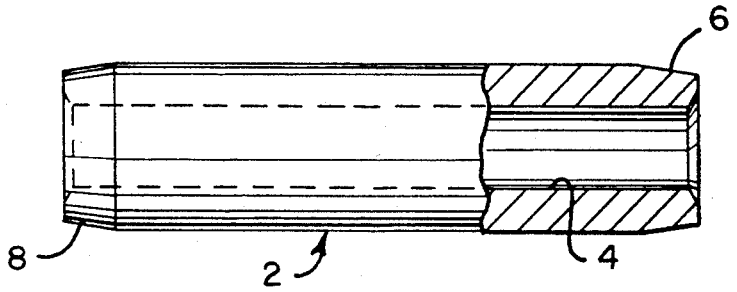
FIG. 1 shows a guide sleeve obtainable with the method and apparatus of the subject invention.
Figure 2:
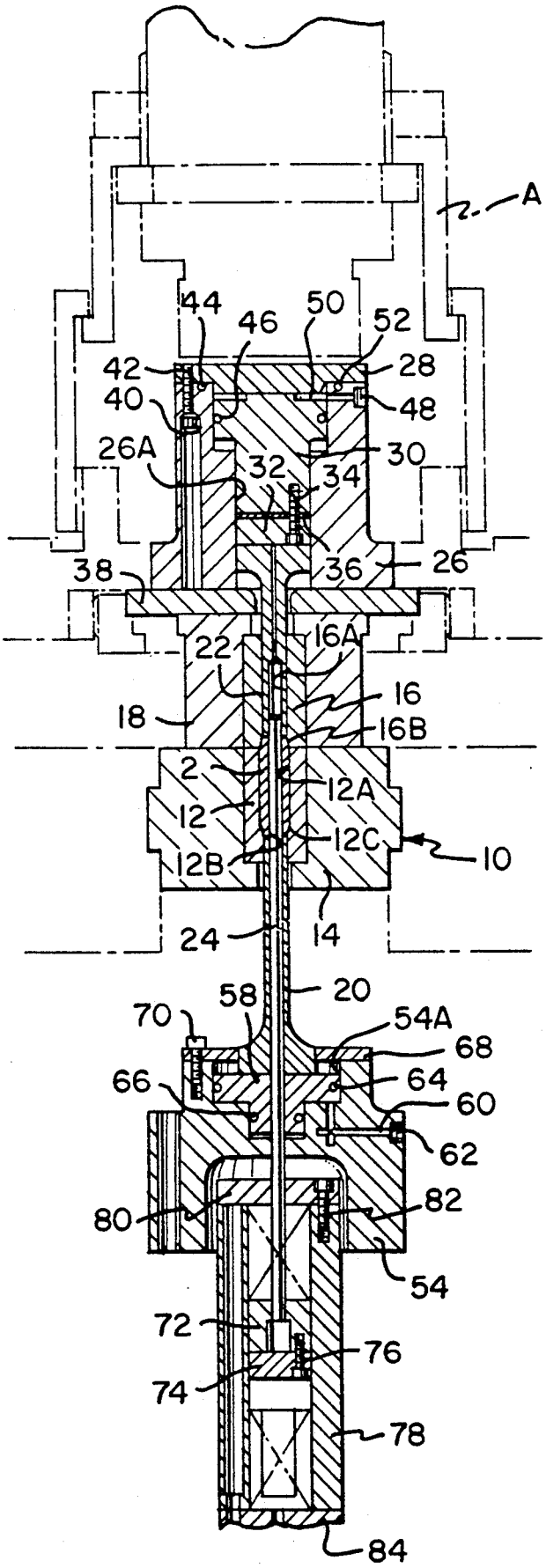
FIG. 2 shows an elevational cross-sectional view of the improved coining apparatus.

FIG. 1 shows a guide sleeve which is used in guiding a valve stem of a valve of an internal combustion engine. The guide sleeve 2 has a guide bore 4 in which the valve stem is slidingly displaceable, and tapered leads 6 and 8 at opposite ends thereof. Such a guide sleeve is generally made of a powdered metal. An apparatus for coining the opposite ends 6 and 8 is shown in FIG. 2. The apparatus 10 comprises a lower die 12 supported in a lower die casing 14 fixedly secured to the base of a crank press, and an upper die 16 supported in a displaceable upper die casing 18. The lower die 12 has a stepped bore having a first portion 12A and a second portion 12B of a smaller diameter than the first bore portion 12A. A tapered transitional surface 12C between the first and second bore portions defines a coining surface of the lower die 12. The upper die 16 has a bore 16A having at an end face thereof facing the lower die, and a tapered inner surface 16B which defines the coining surface of the upper die. A lower punch 20 extends into the second bore portion 12B of the lower die 12, and an upper punch 22 extends into the bore 16A of the upper die. The upper die casing 18 is fixedly connected with an upper cylinder housing 26 having a chamber 26A sealed at the end with an upper cylinder plug 28. A top piston 30 connected with the top punch 22 is displaceable in the upper cylinder housing chamber 26A. The top punch 22 is fixedly connected with a piston spacer 32 which is connected to the top punch piston 30 with several bolts 34. The top piston spacer 32 is separated from the top piston 30 by a spacer 36. The upper die casing 18 is generally connected with upper cylinder housing 26 and an intermediate back-up plate 38. The upper cylinder housing 26 has several vertical bores 40 through which bolts 42 extend to secure the upper cylinder housing 26 with the upper cylinder base 28. The upper portion of the upper cylinder chamber 26A in which the upper piston 30 is displaceable is sealed from the outside with sealing rings 44 and 46. The upper cylinder housing 26 has at the upper end thereof an air inlet 48. The air inlet 48 communicates with a recessed portion 50 at the upper end face of the upper piston 30 through a channel 52. The cylinder housing 26 is connected to a press slide A of conventional construction.

In FIG. 2, numeral 54 designates a lower cylinder housing. The lower cylinder housing 54 has a chamber 54A in which a lower punch piston 58, fixedly connected with a lower punch 20, is displaceable. The chamber 54A is connected by a conduit 60 with an air inlet 62 of the lower cylinder housing 54. The chamber 54A is sealed from the outside with sealing rings 64 and 66, and is closed with a cap 68. The cap 68 is secured to the lower cylinder housing 54 with bolts 70.

The support rod 24 is fixedly secured to a support rod holder 72. The support rod holder 72 is fixedly secured to the rod holder piston 74 with bolts 76. The support rod holder assembly is located in a support rod housing 78 closed by a housing cover 80 which is secured to the housing 78 with bolts 82. At the bottom, the support rod housing 78 is closed with a base plate 84.

The coining of the guide sleeve blank is effected as follows. With the die 16 in its casing 18 separated from the die 12 in its casing 14, a cylindrical blank is loaded from above onto the extended support rod 24 and slides into the bore of the lower die 12 until it abuts the upper edge of the transitional surface 12C. Thereafter, the air is supplied to inlets 48 and 62 of the upper and lower cylinder housings 26 and 54, respectively, to effect displacement of the upper piston 30 and the lower piston. Upon displacement of the pistons, the upper punch 22 and the lower punch 20 move relative to respective dies. The elements are sized and positioned so that when the respective punches are extended, the end faces of the respective punches will be aligned with the beginning of the transitional sections 12C and 16B of the lower and upper dies. Accordingly, the lower end face of the sleeve 2 will sit on the punch 20. Thereafter, the upper die assembly which is connected to a slide A of a crank press is moved downward to effect a coining operation. As the upper end of the sleeve 2 enters the upper die cavity, the upper end face is engaged by the punch 22. Continued downward movement of the upper die causes the blank to enter the transitional sections 12C and 16B of the respective die cavities to effect the coining operation to provide tapered surfaces adjacent each end of the sleeve. During this movement of the sleeve, the ends thereof remain in contact with the ends of the respective punches so that the end faces of the sleeve are supported during the coining process. As the sleeve enters the tapered sections, the punches are moved rearwardly against the air pressure in the respective chambers 54A and 26A. After completion of the coining cycle, the upper die is moved upwardly, and the lower cylinder 54 is displaceable together with the punch 20 to eject the finished guide sleeve.

Figure 3:
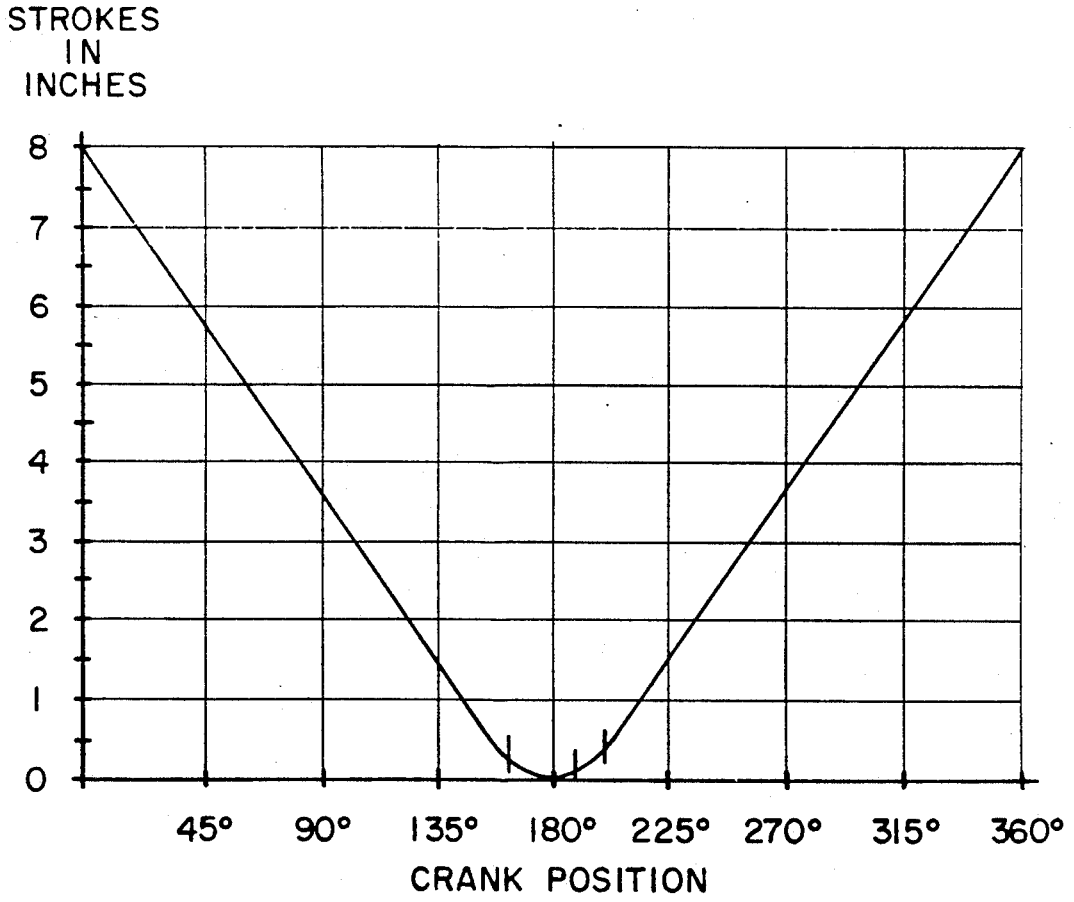
FIG. 3 shows a timing sequence diagram of the press cycle for coining the guide sleeves.

FIG. 3 shows a timing diagram of the press cycle during the coining operation. The diagram of FIG. 3 shows the stroke of the punch in inches in accordance with the angular position of the crank. Starting from an initial 0° position, the punch is fully extended. At 5° of angular position of the crank, the upper and lower punches begin to extend to engage the opposite end faces of the guide sleeve. This process continues up to 150° angular position of the crank, at which position a full contact of the upper and lower punches with the end faces of the guide sleeve is completed and compression of the sleeve starts. The compression continues to a 180° angular position of the crank in which point the upper and lower punches are in full anvil position. The linear travel of the upper and lower punches from 150° to 180° of angular position of the crank is 0.406 inches. The ejection starts at 190° angular position of the crank. At the start of the ejection, the upper and lower punches continue to support the guide sleeve at opposite end faces thereof. At 210° angular position of the crank, the upper end face of the guide sleeve begins to clear, and this cycle continues until the crank is at 270° angular position, at which position the actual ejection starts. The guide sleeve is completely ejected from the lower die at 360° angular position of the crank, and a new cycle begins with the loading of a new guide sleeve blank.

Figure 4:
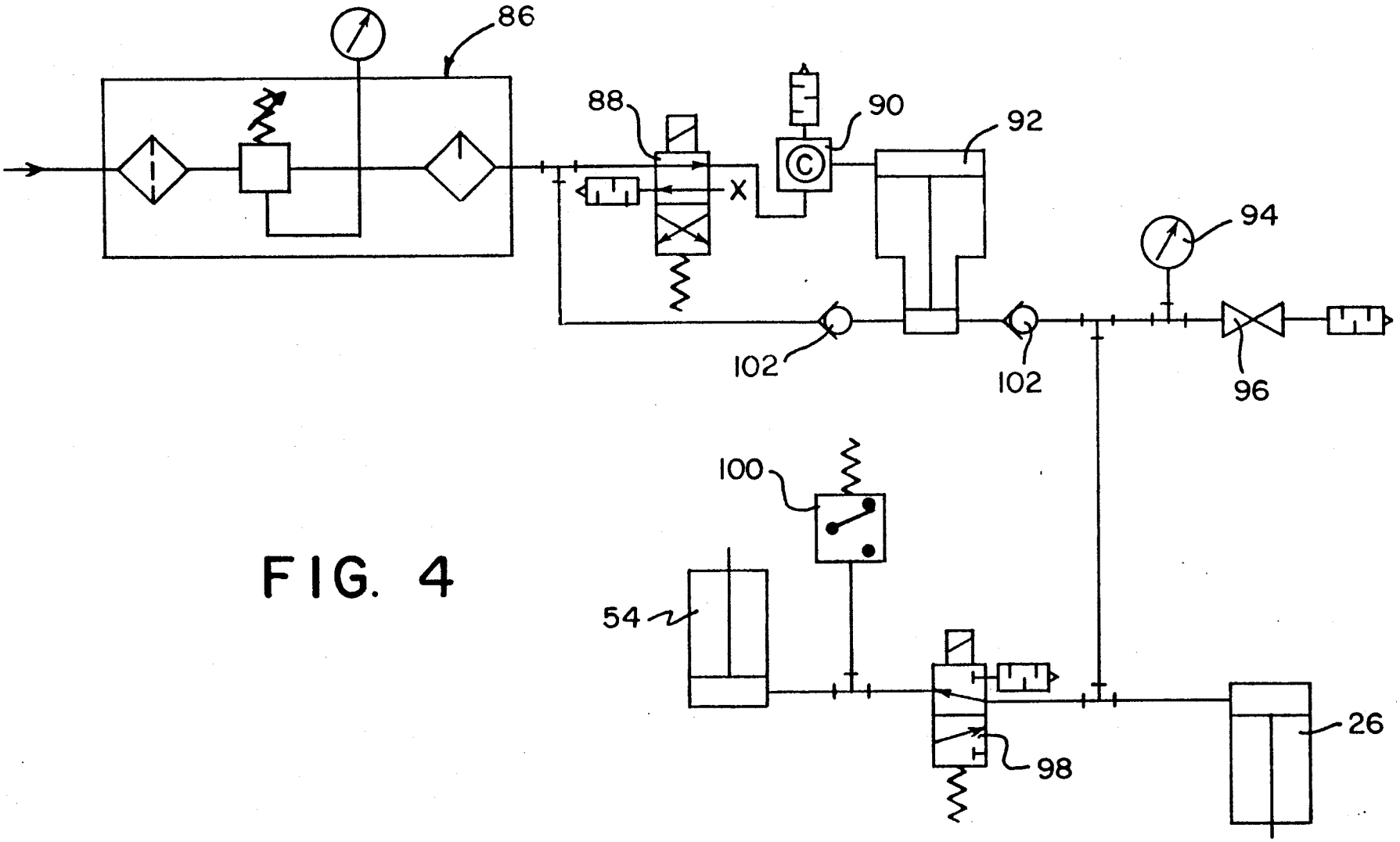
FIG. 4 shows schematically a pneumatic control diagram for use with apparatus of the present invention.
Figure 5:
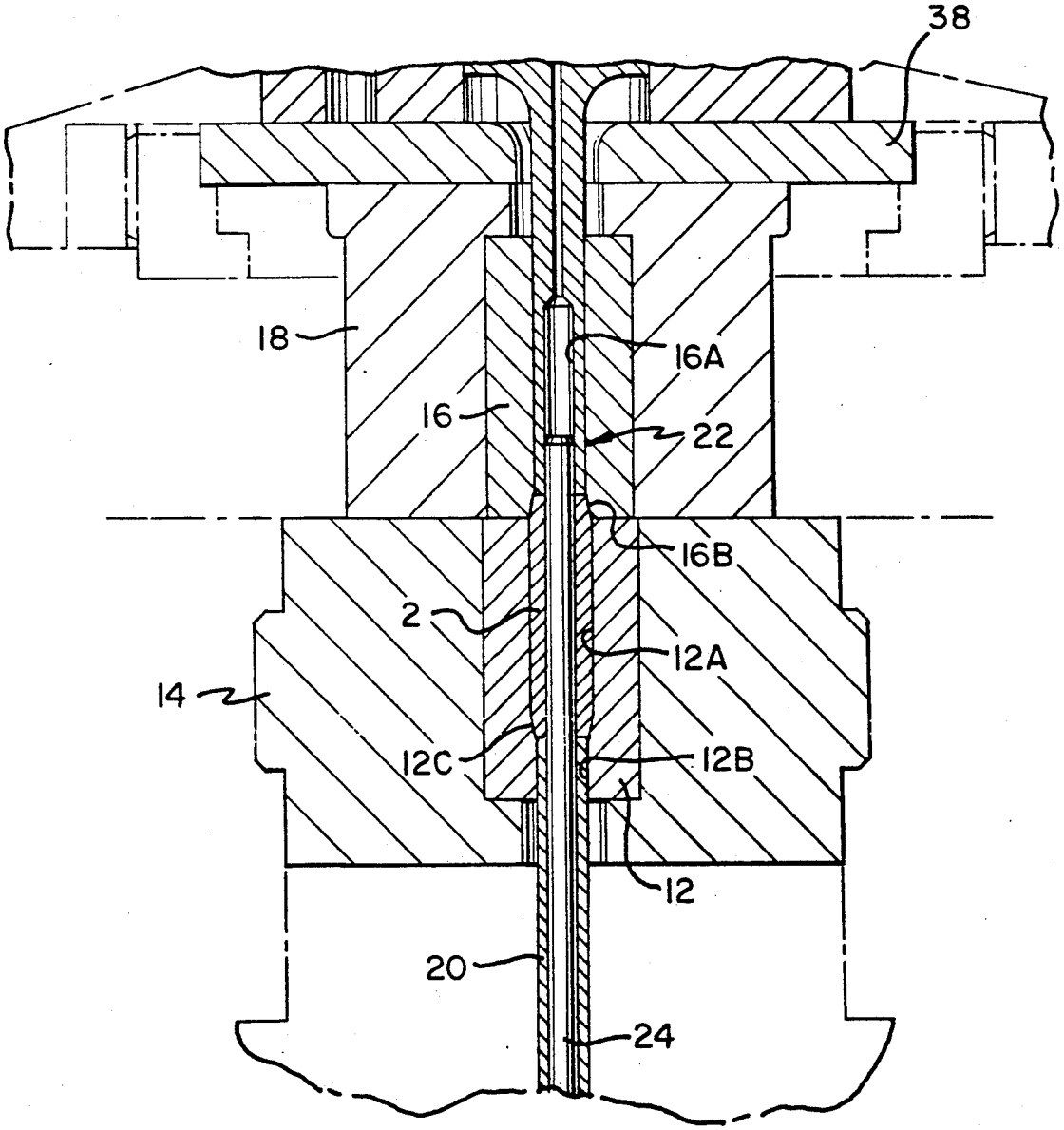
FIG. 5 is a portion, to enlarged scale of FIG. 2.

The pneumatic circuit used for controlling operation of the upper and lower cylinders is shown in FIG. 4. The circuit includes a flow-regulator-lubricator 86 which maintains pressure in the system and from which air is supplied via a solenoid two-position four-way valve 88 and a reset valve 90 to air booster 92. From the booster 92 air pressure is directed to cylinder 54. The air pressure to the cylinders is monitored by an air gauge 94, and excess pressure is vented by using a two-way manual valve 96. A two-position three-way valve 98 controls air flow to the lower cylinder. A pressure switch 100 monitors air pressure supplied to the lower cylinder. The required pressure in the system is maintained by two check valves 102. The operation of the system will be described with reference to the time sequence diagram.

At 5° oc angular position of the crank, the valves 88 and 98 are actuated to enable flow of air to the upper and lower cylinders. The air pressure is applied to the cylinders at the start of the coining stroke. If the pressure switch does not register pressure in the cylinders, it will turn the press off. At 210° of the angular position of the crank, when the upper and fall of the guide sleeve begins to clear, the valve 98 is de-actuated to prevent damage to the workpiece by depressurizing the bottom cylinder 54. After ejection of the workpiece, the press stops at the angular positions of the crank 0°–5°, and the valve 90 reset the booster.

While the invention has been described herein with reference to a preferred embodiment, numerous variations may be made in the method and apparatus herein described without departing from the scope of the invention set forth in the appended claims.

What is claimed is:

1. A method of coining at least one of opposite end faces of a sleeve member with an apparatus including a first die having a first bore portion for receiving the sleeve member therein, said first bore portion having a first diameter corresponding to an outer diameter of the sleeve member, and a transition surface defining a coining surface; a rod member extending through said first bore portion for completely supporting the sleeve member internally along its longitudinal extend; a first punch being independently movable with respect to said rod member extending through said first bore portion for engaging the at least one end face of the sleeve member to support the sleeve member during the coining; and a second die cooperating with said first die to effect a coining operation, and a second punch extending in said second die for engaging the other of said opposite end faces of the sleeve member to support the sleeve during coining, said method comprising the steps of:

loading the sleeve member on the supporting rod and introducing said sleeve into said first bore portion;

advancing the first and second punches into engagement with the opposite end faces of the sleeve member;

compressing said sleeve between said punches by forcing said first and second punches toward each other;

advancing at least one of said dies to effect the coining operation while the sleeve member is being continuously compressed from the opposite faces thereof by said second punch and said first punch;

withdrawing said at least one advanced die to an initial position thereof; and ejecting the coined sleeve member.

2. A method as set forth in claim 1 wherein said second die has a second bore portion into which the second punch extends, said method further comprising the step of providing an inner surface at an end of the second bore portion facing the first die for coining the other of the opposite end faces of the sleeve member.

3. An apparatus for coining at least one of two opposite ends of a sleeve member having a central longitudinal guide bore on a press having a displacable slide, said apparatus comprising:

a first die having a bore with a first bore portion for receiving the sleeve member therein, said first bore portion having a first diameter corresponding to an outer diameter of the sleeve member, and a transition surface defining a coining surface, said first die being stationarily supported;

a rod member extending through said bore of said die for extending through said guide bore and completely supporting the sleeve member internally along its longitudinal extent;

a first punch being independently movable with respect to said rod member and having an annular end face, said first punch extending into said bore;

first means for advancing said first punch at least to an edge of said transition surface and for maintaining said first punch in continuous compressive contact with one said sleeve member end during the coining cycle;

second means for advancing said first punch into said first bore portion of said first die to eject the sleeve member after a coining operation has been completed;

second die means cooperating with said first die to effect the coining operation and comprising a second punch having an annular end face;

third means for advancing said second punch end face into continuous compressive engagement with the other end of said sleeve member during the coining cycle; and fourth means for advancing said second die toward said first die to effect the coining operation.

4. An apparatus as in claim 3, wherein said second means for advancing comprises a displacable cylinder housing having a chamber and conduit means for communicating fluid to and from said chamber, said first means for advancing comprising a piston fixedly connected with said first punch and displacable in said chamber.

5. An apparatus as in claim 3, wherein said second die means comprises a second die having a second bore into which said second punch extends, said fourth means for advancing comprising a cylinder fixedly connected with said second die means for joint displacement therewith and having a chamber and a conduit for communicating air pressure to and from said chamber, said third means for advancing comprising piston means displacable in said cylinder chamber and fixedly connected with said second punch for displacing said second punch relative to said second die.

6. An apparatus as in claim 5 wherein said second die has an inner chamfer at an end of said second bore for coining the other of said opposite ends of the sleeve member.

7. An apparatus as in claim 3 wherein said rod member, punches, and dies are coaxially aligned, said rod extending axially through said first punch and being axially moveable relative to said first punch.

8. An apparatus as in claim 7, wherein said rod has a length for extending entirely through said central longitudinal guide bore of a sleeve whereby said guide bore is fully and continuously supported during said coining cycle.

9. An apparatus as in claim 8, wherein said second punch includes a recess surrounded at its entrance by said second punch annular end face, said rod extending into said recess during said coining cycle.

* * * * *

UNITED STATES PATENT AND TRADEMARK OFFICE

CERTIFICATE OF CORRECTION

PATENT NO. : 5,177,991

DATED : January 12, 1993

INVENTOR(S) : Reynald SANSOUCY

It is certified that error appears in the above-indentified patent and that said Letters Patent is hereby corrected as shown below:

Column 4, line 51, claim 1, please change "extend" to --extent--.

Signed and Sealed this

Twenty-fifth Day of January, 1994

*Attest:*

*Attesting Officer*

BRUCE LEHMAN

*Commissioner of Patents and Trademarks*